US006598762B2

(12) United States Patent
McKune

(10) Patent No.: US 6,598,762 B2
(45) Date of Patent: Jul. 29, 2003

(54) COATING TOUCH UP KIT

(75) Inventor: Brian McKune, Alpine, CA (US)

(73) Assignee: Affinity Management Solutions, Inc., El Cajon, CA (US)

( * ) Notice: Subject to any disclaimer, the term of this patent is extended or adjusted under 35 U.S.C. 154(b) by 0 days.

(21) Appl. No.: 10/051,113

(22) Filed: Jan. 22, 2002

(65) Prior Publication Data

US 2002/0100769 A1 Aug. 1, 2002

Related U.S. Application Data

(60) Provisional application No. 60/265,093, filed on Jan. 31, 2001.

(51) Int. Cl.[7] ..... B65D 25/08

(52) U.S. Cl. ..... 222/82; 222/81; 222/83.5; 222/129; 222/402.1

(58) Field of Search ..... 222/81, 82, 83, 222/83.5, 129, 402.1; 206/219; 215/DIG. 8

(56) References Cited

U.S. PATENT DOCUMENTS

| | | | | | |
|---|---|---|---|---|---|
| 832,168 | A | | 10/1906 | Schopflocher | |
| 2,230,747 | A | | 2/1941 | Greene | |
| 3,156,369 | A | | 11/1964 | Bowes et al. | |
| 3,240,403 | A | * | 3/1966 | Modderno | 206/221 |
| 3,318,484 | A | * | 5/1967 | Modderno | 206/221 |
| 3,355,238 | A | * | 11/1967 | Schwartzman | 222/80 |
| 3,385,503 | A | | 5/1968 | Stump | |
| 3,603,469 | A | | 9/1971 | Magni | |
| 3,603,483 | A | * | 9/1971 | Morane et al. | 222/82 |
| 3,648,899 | A | * | 3/1972 | Lukesch et al. | 222/136 |
| 3,715,189 | A | | 2/1973 | Nighohossian | |
| 3,731,853 | A | | 5/1973 | Baumann | |
| 3,840,136 | A | | 10/1974 | Lanfranconi | |
| 4,195,730 | A | | 4/1980 | Hunt | |
| 4,195,731 | A | | 4/1980 | Cavazza | |
| 4,618,444 | A | | 10/1986 | Hudson | |
| 4,776,972 | A | | 10/1988 | Barrett | |
| 4,793,475 | A | | 12/1988 | Itzel | |
| 4,821,923 | A | * | 4/1989 | Skorka | 206/219 |
| 4,962,852 | A | | 10/1990 | Affaitati | |
| 5,029,718 | A | | 7/1991 | Rizzardi | |
| 5,038,951 | A | | 8/1991 | Rizzardi | |
| 5,370,222 | A | | 12/1994 | Steigerwald | |

(List continued on next page.)

*Primary Examiner*—Kenneth Bomberg
(74) *Attorney, Agent, or Firm*—Venable LLP; Richard L. Aitken

(57) ABSTRACT

In a touch up kit for painting small surface areas, an outer container contains a paint or primer coating material and an inner container contains a catalyst for the paint or primer material. The inner container comprises a bottom seal member closing the bottom of the inner container and an upper seal member closing the top of the inner container. The inner container is nested in the mouth of the outer container. The upper seal member is pierceable by a blunt instrument such as the inlet tube of an aerosol spray canister and the bottom seal member is designed to be detached from the bottom of the inner container in response to downward pressure on the bottom seal member by the inlet tube of the aerosol canister. In use, the inlet tube of the aerosol canister is used to puncture the upper seal member of the inner container and to exert downward pressure on the bottom seal member to completely detach it from the inner container allowing the catalyst in the inner container to drop into the paint or primer coating material within the outer container. The assembly of the inner and outer containers is vigorously shaken to thoroughly mix the catalyst with the paint or primer coating material. The canister is then used to spray the paint or primer mixture on to the surface to be coated. Following the coating process the remaining material in the two containers is allowed to dry whereupon it can be discarded in conventional trash.

10 Claims, 1 Drawing Sheet

U.S. PATENT DOCUMENTS 5,772,017 A 6/1998 Kang
5,957,335 A * 9/1999 Otto ..... 222/129
5,984,141 A 11/1999 Gibler
6,003,728 A * 12/1999 Elliott ..... 206/219
6,041,969 A * 3/2000 Parise ..... 206/219
6,148,996 A 11/2000 Morini
6,152,296 A 11/2000 Shih
6,182,865 B1 * 2/2001 Bunschoten et al. ..... 222/136
6,290,100 B1 * 9/2001 Yacko et al. ..... 222/129

* cited by examiner

COATING TOUCH UP KIT

This application claims the benefit of application serial No. 60/265,093 filed Jan. 31, 2001 entitled Two Part Touch Up Kit Packaging Technology.

BACKGROUND OF THE INVENTION

This invention relates to coating systems for facilitating the application of a coating to a surface wherein the coating is polyurethane or other material of the type in which the coating material needs to be mixed with another coating material such as a catalyst immediately prior to the application of the coating to a surface. Polyurethane paint and primer is typically used in painting aircraft. When such a coating is used, the coating and the catalyst should be kept in sealed containers until they are mixed and then the coating should be applied to the surface to be coated soon after mixing. The amount of catalyst to be used with the paint or primer must be precisely in the correct proportions to provide satisfactory results. The coating process presents a problem when the coating project is merely a touch up application in which a very small surface area is to be covered. When a conventional container of polyurethane coating material is opened along with the catalyst, precise amounts of the coating and catalyst have to be measured out and mixed. Precision in the amounts of the mixed components is difficult, because some of the measured amounts remain coated on the walls of the measuring vessel instead of winding up in the mixture. In a touch up application, only very small amounts of the polyurethane coating material and catalyst will be needed, so the remainder of the coating material and catalyst in the open containers will typically be wasted. In addition the unused parts of the coating material and catalyst must be disposed of. Often the unused coating material is hazardous waste which requires documented disposal. In addition care often must be taken to avoid unsafe contact of the coating material with the persons using the material.

SUMMARY OF THE INVENTION

The present invention overcomes the problems associated with touch up applications by means of a unique packaging technology in which a small amount of the uncatalyzed paint or primer is contained in an outer container and the catalyst is contained in an inner container within the outer container. The top of the inner container is closed with a puncturable seal and the bottom of the inner container is closed with a seal which is designed to completely detach from the inner container in response to downward pressure from within the inner container. The inner container nests within the mouth of the outer container and the two containers combined are closed with a cap which screws onto the neck of the outer container. The inner container when closed with the cap of the outer container makes an air tight seal with the neck of the outer container thereby providing a sealed enclosure around the paint or primer within the outer container.

To use the paint kit, the cap is removed and the inlet tube of an aerosol spray canister is manipulated to puncture the upper seal on the inner container and is inserted through the inner container to engage the lower seal closing the bottom of the inner container. The aerosol inlet tube is pushed downwardly against the lower seal causing it to completely detach from the lower end of the inner container and allowing the catalyst to drop into the paint or primer in the outer container. The lower end of the canister is provided with a mounting structure which screws onto the neck of the outer container. After the lower seal is dislodged from the inner container, the mounting structure is screwed onto the neck of the outer container, whereupon the combined containers are vigorously shaken to thoroughly mix the catalyst and the paint or primer in the exact proportions for satisfactory use. Because the material coating the walls of the nested container becomes thoroughly mixed in the vigorous shaking, the precision of the amounts of the mixed components is achieved even though only small quantities are mixed.

By actuating the aerosol spray canister, the mixed catalyst and paint or primer can then be sprayed onto the surface to be coated in the touch up application.

Following the touch up painting operation, the aerosol canister is removed from the inner and outer containers and the material within the inner and outer container is allowed to dry. The containers with the dried unused coating materials can be then disposed of in accordance with local disposal regulations. Because the two containers contain the exact proportions of the catalyst and paint or primer needed and contain these proportions in only small amounts, the problem of waste and waste disposal is avoided, while at the same time ease and convenience in carrying out the touch up painting operation is achieved with limited risk of the coating material coming into contact with the user.

The two part container described above can also be used with a brush to carry out the touch up painting application.

DESCRIPTION OF THE PREFERRED EMBODIMENT

Figure 1:
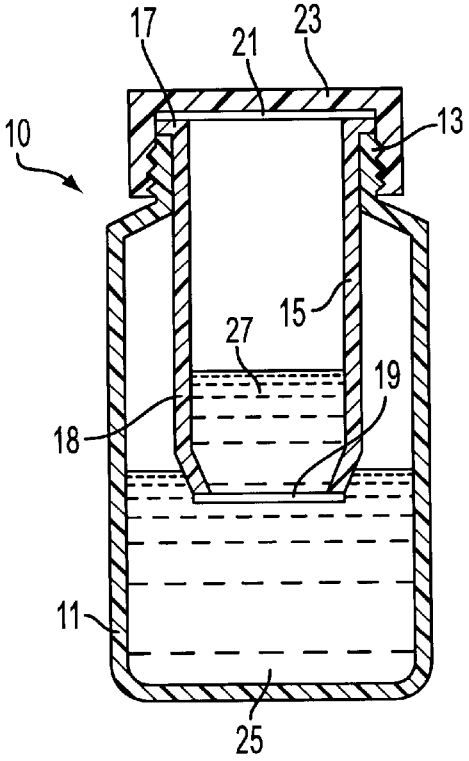
FIG. 1 illustrates an axial sectional view of the touch up kit of the invention prior to the connection of the kit to an aerosol spray canister.

As shown in FIG. 1 the paint kit of the present invention comprises an outer container or vessel 10 comprising a plastic bottle having an enlarged lower reservoir 11 and formed into a neck 13 at the upper end defining the mouth of the outer container. Nested within the mouth of outer container is the inner container 15, which is also made primarily of plastic and which has tapered annular sidewalls 18 sized to make a snug sliding fit with the inner wall surface of the neck 13 of the outer container. The upper end of the inner container 15 is formed into an outwardly extending flange or lip 17, which fits over and engages the annular upper end wall of the neck 13. The lower end of the container 15 is closed with a sealing member 19, which is sealed to the lower annular end wall of the sidewalls 18 in a readily detachable seal. The upper end of the inner container is closed with a sealing member 21 which is designed to be readily puncturable with a blunt instrument such as the tubular inlet tube of an aerosol spray canister as will be described below. The outer surface of the neck 13 is provided with the threads and a cap 23 is provided with matching threads on its inner sidewalls so that the cap 23 can be screwed onto the neck 13 to press the lip 17 against the annular upper end of the neck 13 so as to provide an air tight seal to the contained space between the inner container 15 and the outer container 10. The outer container is about half filled with a liquid coating mixture component such as a paint or primer 25 so as to partially fill the space between the inner and outer containers. The inner container 15 is about half filled with a second liquid coating mixture component such as a catalyst 27 for the paint or primer 25.

Figure 2:
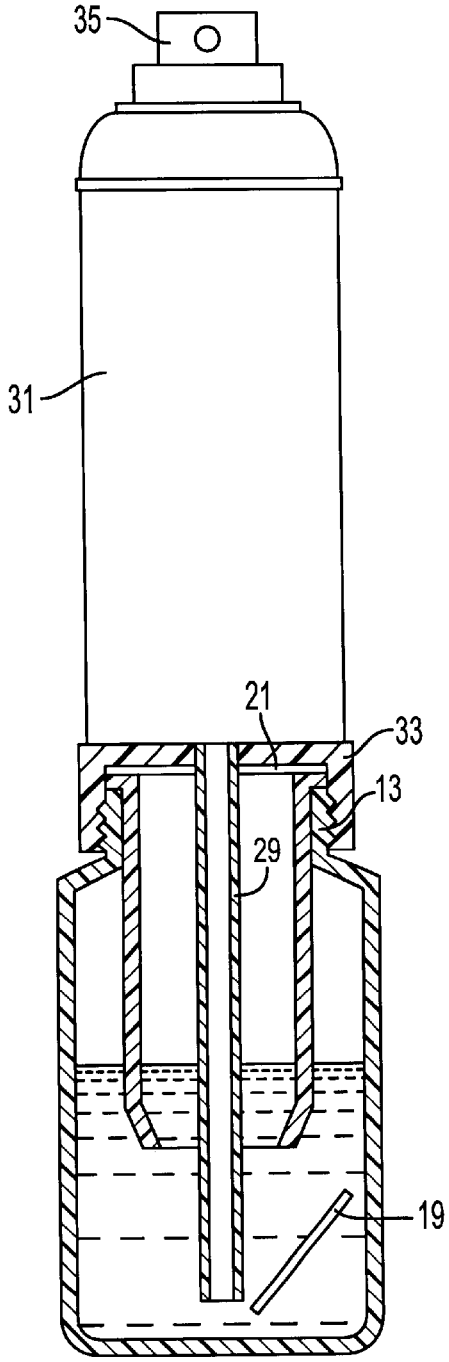
FIG. 2 is a partial axial sectional view of applicants touch up painting system with the aerosol spray canister employed in the invention mounted on the nested containers of the touch up kit ready for use in a spray paint application.

To use the touch up paint kit with an aerosol spray canister 31, as shown in FIG. 2, the cap 23 is removed and an inlet tube 29 extending out of the bottom of an aerosol canister is used as a blunt instrument to first puncture the seal 21 so that the tube can be inserted through the inner container 15 to engage the sealing member 19. The tube is pushed down against the sealing member 19 to forceably disengage the sealing member 19 from the end wall of the sidewalls 18. The sealing member 19 is designed and structured so that when the downward force is applied to the sealing member 19 by the inlet tube, the sealing member is completely disengaged from the inner container 15. As a result the lower end of the inner container 15 is completely open to the enclosed space within the outer container 10 and the catalyst drops into the paint or primer. The aerosol applicator is provided with a mounting member 33 which is very similar to the cap 23 and which can be screwed onto the neck 13 to mount the canister to the neck 13 and reclose the mouth of the nested inner and outer container, with the inlet tube 29 extending down through the coating material to near the bottom of the outer container 10, as shown in FIG. 2. With the canister 31 mounted onto the neck 13 of the outer container 10 in this manner, the combined elements comprising the canister 31, the outer container 10 and the inner container 15 are vigorously shaken to completely mix the catalyst 27 with the paint or primer 25 originally contained in the outer container 10.

The aerosol canister 31 is available on the market and contains a gas under pressure which is released through a nozzle 35 at the upper end of the canister 31 when finger pressure is applied to the nozzle. The release of gas through the nozzle 35 draws the mixed paint and catalyst up through the tube 29 to be discharged from the nozzle 35 in an aerosol spray for applying to the surface to be coated.

Since the coating mixture is to be used in a touch up application, the volume of the coating mixture is small and in one preferred embodiment is about 2 ounces which will cover about two square feet of surface. Ideally the volume should be just enough to cover the surface to be coated depending upon the touch up application. The volume of the coating mixture should be in the range of about 1 ounce to 10 ounces. Most touch up applications will be satisfactory covered with a coating mixture volume in the range of 2 to 4 ounces.

After the touch up painting application has been completed, any remaining coating material in the containers 10 and 15 and on the sidewalls of these containers is allowed to dry whereupon the dried coating material in the containers can be disposed of in conventional waste disposal receptacle.

Instead of using an aerosol canister to apply the mixed catalyst and paint or primer to a surface, the mixed coating material and catalyst may be applied by a brush. In the alternative method of using the touch up kit, a dull implement, such as a tongue depressor, is used to pierce the upper seal member 21 and to dislodge the lower seal member 19 from the sidewalls 18. The cap 23 is then screwed tightly back in the neck 13 and the capped nested container is shaken vigorously to achieve mixing. After the cap 23 is again removed a paint brush can be dipped into the mixed coating material and used to apply the coating material to a surface.

In the paint kit as described above, small amounts of coating material and catalyst are readily mixed in the precise proportions needed for satisfactory application of the coating material to a surface. The paint kit enables the mixed coating material to be applied to a small surface to be covered in the touch up application with ease and convenience and permits convenient disposal of the unused components.

In the preferred embodiment of the paint kit coating mixture components are liquid. However, one of the components such as the catalyst, could be in a solid form, such as a powder, which dissolves into the other coating mixture component. In the preferred embodiment, the second mentioned container, called the inner container, is positioned within the outer container mounted at the mouth of the outer container as this arrangement provides the greatest convenience in the use of the paint kit. However, instead of positioning the second container within the first container, the second container could be positioned outside of said first container mounted on said first container at the mouth of said first container. These and other modifications may be made to the above described specific embodiments of the invention without departing from the spirit and scope of the invention, which is defined in the following claims.

What is claimed is:

1. A method of preparing and applying a coating mixture to a surface to be coated comprising providing an outer container containing a first coating mixture component and an inner container containing a second coating mixture component, said inner container being positioned in said outer container and mounted at a mouth of said outer container, said inner container comprising annular sidewalls and a bottom sealing member closing the bottom of said inner container; exerting downward pressure on said sealing member with an instrument separate from said sealing member to completely dislodge said sealing member from said inner container to allow said sealing member to fall completely away from said inner container and allow said second coating mixture component to drop into said first coating mixture component, mixing said first and second coating components in said outer container to produce said coating mixture; applying said coating mixture to the surface to be coated, wherein said coating mixture is applied to said surface by means of an aerosol spray canister, and wherein said aerosol spray canister is mounted on said outer container by screwing a mounting member onto a neck of said outer container defining said mouth of said outer container.

2. A touch up kit for preparing a coating mixture to be applied to a surface in a touch up application, comprising an outer container having a mouth and containing a component of a coating mixture, an inner container positioned in said outer container mounted at said mouth of said outer container and containing a second component of said coating mixture, said inner container comprising sidewalls and a sealing member closing the bottom of said inner container, said sealing member being detachable from the sidewalls of said inner container to open the bottom of said inner container and allow the second component of said coating mixture to mix with said first component of said coating mixture wherein said mouth of said outer container is defined by a neck on the upper end of said outer container, said neck being provided with screw threads, and a cap having screw threads adapted to mate with the screw threads on the neck of said container and screwed on the screw threads on said neck to enclose said coating components in an air tight container, and wherein said inner container has an outwardly extending flange on the upper end thereof fitting with the upper end wall of said neck, said cap sandwiching said flange between said cap and said upper end walls and pressing said flange against said upper end wall to create an air tight seal.

3. A touch up kit for preparing a coating mixture to be applied to a surface in a touch up application, comprising an outer container having a mouth and containing a component of a coating mixture, an inner container positioned in said outer container mounted at said mouth of said outer container and containing a second component of said coating mixture, said inner container comprising a sidewall, an upper sealing member closing the top of said inner container, and a lower sealing member closing the bottom of said inner container, said upper sealing member comprising a readily puncturable sheet of material, said sidewall having an axially facing endwall, said lower sealing member being detachably sealed to said endwall, a dull instrument adapted to first pierce the sheet of said upper sealing member and then to engage said lower sealing member from within said inner container and exert downward pressure on said lower sealing member to open the bottom of said inner container and allow the second component of said coating mixture to mix with said first component of said coating mixture, wherein said lower sealing member is constructed so that said lower sealing membeer is connected only to said endwall and completely detaches from said sidewalls to fall completely away from said sidewalls in response to downward pressure applied to said sealing member from within said inner container by said dull instrument.

4. A touch up kit as recited in claim 3 wherein said first and second components of said coating mixture are liquids.

5. A touch up kit as recited in claim 3 wherein one of said coating mixture components comprises a catalyst.

6. A touch up kit as recited in claim 5 wherein said catalyst comprises said second coating mixture component contained in said inner container.

7. A touch up kit as recited in claim 3 wherein said mouth of said outer container is defined by a neck on the upper end of said outer container, said neck being provided with screw threads, and a cap having screw threads adapted to mate with the screw threads on the neck of said container and screwed on the screw threads on said neck to enclose said coating components in an air tight container.

8. A method of preparing and applying a coating mixture to a surface to be coated comprising providing an outer container containing a first coating mixture component and an inner container containing a second coating mixture component, said inner container being positioned in said outer container and mounted at a mouth of said outer container, said inner container comprising annular sidewalls, an upper sealing member in the form of a puncturable sheet closing the top of said inner container, and a bottom sealing member in the form of a sheet closing the bottom of said inner container; puncturing said sheet with an end of an instrument, and then passing said end of said instrument through the puncture in said upper seal member to engage the sheet of said lower sealing member with said instrument to exert downward pressure on said lower sealing member with said instrument to completely dislodge said lower sealing member from said inner container to allow said sealing member to fall completely away from said inner container and allow said second coating mixture component to drop into said first coating mixture component, mixing said first and second coating components in said outer container to produce said coating mixture; applying said coating mixture to the surface to be coated.

9. A method as recited in claim wherein said coating mixture is applied to said surface by means of an aerosol spray canister.

10. A method as recited in claim 9 wherein said first and second coating mixture components are mixed by shaking the assembly of said inner and outer containers after said second coating mixture component drops into said first coating mixture component.

* * * * *